United States Patent [19]

Rilling

[11] Patent Number: 5,074,564

[45] Date of Patent: Dec. 24, 1991

[54] GOLF SWING AID

[75] Inventor: John F. Rilling, Roswell, Ga.

[73] Assignee: Golf Research Technology, Inc., Norcross, Ga.

[21] Appl. No.: 682,570

[22] Filed: Apr. 9, 1991

[51] Int. Cl.[5] ..... A63B 69/36

[52] U.S. Cl. ..... 273/186 A; 273/186 R

[58] Field of Search ..... 273/186 R, 186 A, 186 RA, 273/183 R, 183 B, 183 D, 183 DA

[56] References Cited

U.S. PATENT DOCUMENTS

| | | | |
|---|---|---|---|
| 1,990,281 | 2/1935 | Grelle | 273/186 A |
| 2,218,943 | 10/1940 | Whitney | 273/186 A |
| 2,561,272 | 2/1971 | Davis | 273/186 A |
| 3,126,546 | 6/1964 | Connolly | 273/186 A X |
| 3,498,616 | 3/1970 | Hurst | 273/186 A |
| 3,575,419 | 4/1971 | Davis | 273/186 A |
| 4,168,068 | 9/1979 | Grover | 273/186 A |
| 4,614,343 | 9/1986 | Radway | 273/186 A |

*Primary Examiner*—William H. Grieb

*Attorney, Agent, or Firm*—Trexler, Bushnell, Giangiorgi & Blackstone, Ltd.

[57] ABSTRACT

A device comprising a housing containing a pellet, a diaphragm, and means for applying a force for translating the pellet towards the diaphragm to produce a signal disposed within the housing is mounted by C clamps onto a golf club shaft. The signal issues at critical times during a proper golf swing. These signals assist a golfer in improving his swing, resulting in a swing that has a greater balance, synchronicity, symmetry and tempo than before.

10 Claims, 1 Drawing Sheet

GOLF SWING AID

BACKGROUND AND SUMMARY OF THE INVENTION

This invention relates generally to a golf swing aid that assists a golfer in improving his swing. Many golfers are plagued by the adverse effects and consequences of a choppy swing. Many golfers are prone to swing too quickly, and to apply excessive and misdirected force to the golf ball. The effects of these golfer tendencies are most prevalent and visible in driver strokes generally, especially tee strokes, and in strokes involving the use of long to medium range irons. This results in errantly directed strokes, increased golfer frustration with the game, and higher golf scores.

The problem with the swings employed by most golfers is that the swings themselves are not synchronous or symmetrical. In short, the swings lack the proper tempo to produce a stroke of desired length and directivity. Most prevalently, golfers are prone to rush the back swing, which does not allow the golfer appropriate time to set his wrists properly. This leads to a quick, choppy swing, and a poor follow through. Further, golf swings of this type do not allow flush, solid contact between striking face of the club head and the golf ball. Often, the golfer is off balance when he strikes the golf ball while employing this type of swing. All of these factors generally cause the golf ball to be misdirected to the left or the right, and not directed into the area of the playing surface intended. The lack of rhythm and tempo in such swings is a significant impediment to lower golf scores.

OBJECTS AND SUMMARY OF THE INVENTION

A general object of the present invention is to provide a golf swing aid that can assist a golfer in improving his or her swing.

A further object of the invention is to provide a golf swing aid that will encourage a golfer to adopt a swing having greater balance, synchronicity, and symmetry than before.

Another object of the invention is to provide a golf swing aid that will encourage a golfer to adopt a swing that will result in contact between striking face of the golf club head and the golf ball that is flush and solid, resulting in greater control over the direction of travel of the golf ball.

The golf swing aid embodied in the present invention is a great asset to the golfer in that it supplies external indicators to the golfer that can be used to improve his swing. Specifically, if the golfer pauses at the top of his backswing, the golf swing aid produces an audio signal which allows a golfer to know that he has finished his back swing, and is ready to begin his swing downward to strike the golf ball. Further, the golf swing aid produces another audio signal which allows a golfer to determine when he has finished his follow through.

The golf swing aid of the present invention is designed to be connected easily, with a twisting action, to the club shaft of a golf club, preferably on a portion of the shaft halfway between the club head and the grip. The golf swing aid itself is comprised of a housing having a bore passing through the housing. Disposed about the housing are a plurality of opposing C clamps, which effectuate the easy connection between the golf swing aid and the golf club shaft.

In the interior of the housing, disposed within the bore, are a diaphragm, a pellet, a spring, and a base. The spring is disposed on top of the base, and rests upon the base. The pellet rests upon the spring, opposite to the base. The diaphragm is disposed above the pellet, the spring, and the base. When the golf swing aid is assembled, the spring is compressed, and serves to urge the pellet against the diaphragm to produce a signal when the device of the present invention is in use.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which.

DETAILED DESCRIPTION OF THE PREFERRED EMBODIMENT

Figure 1:
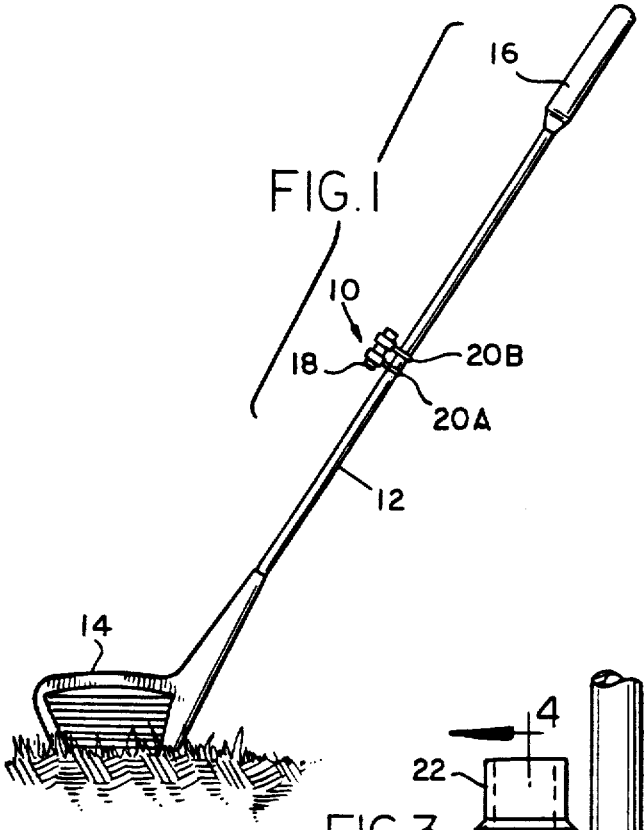
FIG. 1 is a collapsed view of a golf swing aid constructed according to the teachings of the present invention disposed on a golf club, halfway between the club head and the grip.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
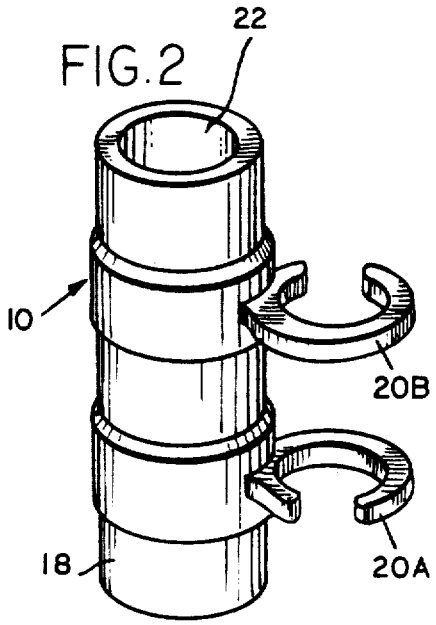
FIG. 2 is an isometric plan view of a golf swing aid constructed according to the teachings of the present invention.

In FIG. 1, a golf club 11 having a golf swing aid 10, disposed on a club shaft 12 between a club head 14 and a club grip 16, is shown. Preferably, the golf swing aid 10 should be located on the club shaft 12 halfway between the club head 14 and the club grip 16. The golf swing aid 10 is constructed of light-weight materials so as not to substantially add to the weight of the golf club 11. In FIG. 2, the golf swing aid 10 is shown with more clarity. Generally, the golf swing aid 10 is comprised of a substantially cylindrical housing 18 having a bore elongated along the axis of elongation of the housing 18, disposed through the housing 18. The housing 18 and the bore 22 have a common central axis. To attach the golf swing aid 10 to the club shaft 12 of the golf club 11, there are a plurality of C clamps 20A and 20B disposed about the exterior of the housing 18. The opening of the C clamp 20A opposes the opening of the C clamp 20B. Those openings are of sufficient size to accommodate the club shaft 12 of the golf club 11. With this particular construction, the golf swing aid 10 is easily attachable to the club shaft 12 of the golf club 11 by means of a simple twisting motion. The attachment of the golf swing aid 10 to the club shaft of the golf club 11 is shown more fully in FIG. 1 and FIG. 3.

Figure 3:
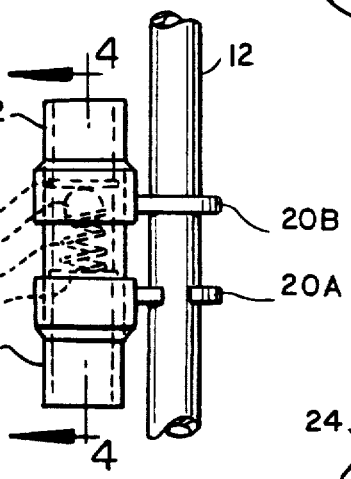
FIG. 3 is an expanded sectional view of the golf swing aid, depicted in FIG. 1, showing the particular disposition of the base, spring, pellet, and diaphragm.
Figure 4:
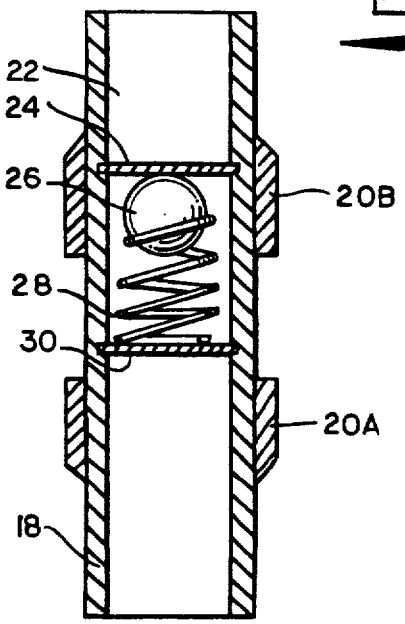
FIG. 4 is an expanded cross-sectional view of the golf swing aid shown in FIG. 1, showing the disposition of the base, spring, pellet, and diaphragm when the golf swing aid is at rest.

Referring generally to FIG. 3 and FIG. 4, the at rest disposition of a fixed element or diaphragm 24, a movable element or pellet 26, a spring 28, and a base 30 is shown. The diaphragm 24, the pellet 26, the spring 28, and the base 30 are disposed within the bore 22. The base 30 is disposed across a cross-sectional area of the bore 22, and is substantially circular in shape. Portions of the base 30 are embedded in the housing 18 for support. The spring 28 is disposed on top of the base 30, and the pellet 26 is disposed on top of the spring 28. The pellet 26 is of sufficient size to be able to engage and compress the spring 28, when a force of sufficient size is applied to the pellet 26. However, the pellet 26 is small enough to be able to freely translate within the bore 22. The pellet 26 is constructed of a material such that it will make a signal, such as an audible sound, upon impact with the diaphragm 24, when the pellet 26 is propelled by a force, due to compression of the spring 28, exerted by the spring 28.

The diaphragm 24 is disposed across a cross-sectional area of of the bore 22 above the pellet 26, the spring 28, and the base 30, and is substantially circular is shape. The diaphragm 24 is constructed of a material, such that it will make a signal, such as an audible sound, upon impact with the pellet 26. Portions of the diaphragm 24 are embedded in the housing 18 for support. The positioning and sizing of the base 30, the spring 28, the pellet 26, and the diaphragm 34 are such that, when fully assembled, the spring 28 is compressed, so that the spring 28 forces and resistively holds the pellet 26 in contact with the diaphragm 24, as shown in FIG. 3 and FIG. 4. This loading of the spring 28 allows for determination of the size of the centrifugal force 32 necessary to compress further the spring 28, and to permit the pellet 26 to move axially in the bore 22 out of contact with the diaphragm 24.

Figure 5:
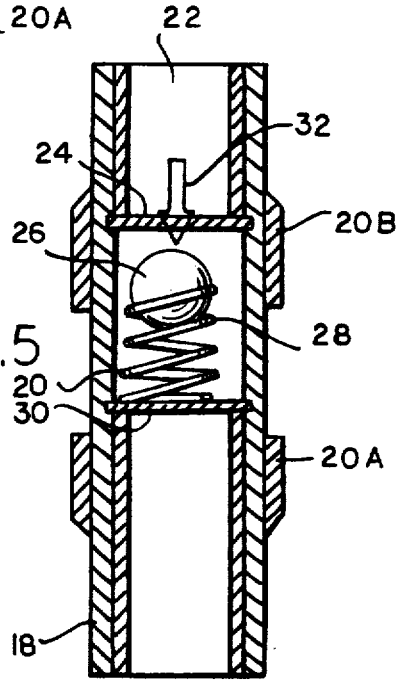
FIG. 5 is an expanded cross-sectional view of the golf swing aid shown in FIG. 1, showing the disposition of the base, spring, pellet, and diaphragm under the influence of a centrifugal force exerted by the rotation of the golf club.

As shown in FIG. 5, when a centrifugal force 32, illustrated in phantom by a vertical arrow, due to the rotation of the golf club 11 and the golf swing aid 10, is applied to the pellet 26, the pellet 26 imparts that centrifugal force 32 to the spring 28. If the centrifugal force 32 is of sufficient magnitude, it will overcome the force imparted by the spring 28 to the pellet 26, thereby compressing the spring 28 and causing the pellet 26 to move away from the diaphragm 24. When this centrifugal force 32 dissipates, due to ceased rotation of the golf club 11 and the attached golf swing aid 10, the force imparted by the spring 28 again becomes controlling, and propels the pellet 26 against the diaphragm 24. Due to the construction of the pellet 26 and the diaphragm 24, an audible sound is produced when the pellet comes into contact with the diaphragm 24.

In use, the golf swing aid 10 is positioned first upon the shaft 12 of the golf club 11. Then, the golfer proceeds to take a number of practice swings, employing a full back swing and a full follow through. When the golfer employs a full back swing, the centrifugal force 32, due to the rotation of the golf swing aid 10 with the golf club 11, imparted to the pellet 26 will overcome the force of the spring 28 holding the pellet 26 in contact with the diaphragm 24, cause the pellet 26 to compress the spring 28, and cause the pellet 26 to move away from the diaphragm 24. Once the back swing has been fully completed, the golfer properly should pause for a short moment before he begins his striking swing. This pause promotes proper tempo in the swing, and helps the golfer to insure that he will strike the golf ball with the striking face of the golf club 11 in a flush and solid manner.

If the back swing is completed, and the golfer pauses for a short moment before beginning his striking swing, the centrifugal force 32 imparted to the pellet 26, due to the rotation of the golf club 11 and the golf swing aid 10, will dissipate. Now, the force imparted by the spring 28 onto the pellet 26 will propel the pellet 26 into contact with the diaphragm 24 once more, resulting in a audible click. This click is the signal to the golfer that he has completed properly his back swing, and now should begin his striking swing. The signal will not issue if the golf club 11 has not come to a stop or has paused a sufficient time interval at the end of the back swing. This signal is issued by the golf swing aid 11 only if the back swing has been completed properly. If the back swing has not been completed properly, no signal will issue, or at least, a signal will issue that is of substantially lower magnitude. The issuance or nonissuance of this signal, and the degree thereof, will assist the golfer to learn how to swing his golf club 11 properly.

But the utility of the golf swing aid 10 does not end there; it further assists the golfer in learning a proper follow through. In this manner, the golfer will learn a completely proper, and likely more accurate, golf swing. It is always important to have a complete and effective follow through when playing golf. In such a follow through, the golf swing aid 10 performs in a manner substantially similar to the manner in which it performed during the back swing.

On the follow through, the centrifugal force 32 imparted to the pellet 26, due to the rotation of the golf swing aid 10 and the golf club 11, will overcome the force imparted onto the pellet 26 by the spring 28. This will cause the pellet 26 to move away from the diaphragm 24 and to compress the spring 28. Once the follow through has been completed properly, the golfer will pause, and the centrifugal force 32 will dissipate. Now, the spring force again is controlling, and will propel the pellet 26 into the diaphragm 24, resulting in an audible click. This click is a signal to the golfer that he has completed his follow through properly. The issuance of this signal is subject to the same limitations described above, and will assist the golfer in improving his golf swing.

Use of the golf swing aid 10 will allow a golfer to improve his golf game in many ways, through the improvement of his swing. By consistent use of the golf swing aid 10, the golfer can increase the synchronicity and symmetry of his swing because he will receive a signal at both the end of his back swing, which is the beginning of his striking swing, and the end of his follow through. Further, the golf swing aid 10 will encourage the golfer to swing in a more complete circle, which will allow him to hit through the golf ball, instead of hitting into the ball.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

The invention claimed is:

1. A golf swing aid for use with a golf club to improve a swing employed by a golfer comprising: a housing having a bore therein; a movable element being disposed within the bore; the movable element being capable of free translation in the bore; a fixed element being disposed within the bore in such a position that the movable element may come into contact with the fixed element to produce a signal; and means for applying a force for translating the movable element towards the fixed element, and means for permitting the movable element to recede from the fixed element under the influence of centrifugal force during a golf swing, and for urging the movable element against the fixed element to provide a signal when the centrifugal force is reduced.

2. A golf swing aid comprising the elements of claim 1 wherein the movable element and the fixed element are constructed of materials that will produce an audio signal when the means for applying a force for translating the movable element towards the fixed element causes the movable element to contact the fixed element after the movable element has receded a certain distance.

3. A golf swing aid comprising the elements of claim 1 wherein the golf swing aid is connectable to a golf club by means of a C clamp disposed about the housing.

4. A golf swing aid comprising the elements of claim 1 wherein the means for applying a force for translating the movable element towards the fixed element is disposed above, and contacting, a base; and the base being disposed within the bore opposite to the fixed element.

5. A golf swing aid comprising the elements of claim 1 wherein the fixed element and the base have portions thereof being embedded within the housing so as to provide support.

6. A golf swing aid comprising the elements of claim 1 wherein the means for applying a force for translating the movable element towards the fixed element comprises a spring.

7. A golf swing aid comprising the elements of claim 1 wherein the means for applying a force for translating the movable element towards the fixed element is capable of being preloaded initially, so that the preloading determines the magnitude of centrifugal force necessary for the movable element to recede a distance sufficient for the proper issuance of the signal; and the movable element and the fixed element being capable of maintaining that means in its preloaded condition when the golf swing aid is at rest.

8. A golf swing aid comprising the elements of claim 1 wherein the movable element comprises a ball bearing.

9. A golf swing aid comprising the elements of claim 1 wherein the fixed element comprises a diaphragm.

10. A golf swing aid for use with a golf club to improve a swing employed by a golfer comprising: a housing having a bore therein; a pellet being disposed within the bore; the pellet being capable of free translation in the bore; a diaphragm being disposed within the bore in such a position that the pellet may come into contact with the diaphragm to produce a signal; and means for applying a force for translating the pellet towards the diaphragm, and means for permitting the pellet to recede from the diaphragm under the influence of centrifugal force during a golf swing, and for urging the pellet against the diaphragm to provide a signal when the centrifugal force is reduced.

* * * * *